US005080435A

United States Patent [19]

Desanta

[11] Patent Number: 5,080,435

[45] Date of Patent: Jan. 14, 1992

[54] CHAIR

[75] Inventor: Simon Desanta, Guetersloh, Fed. Rep. of Germany

[73] Assignee: Haworth, Inc., Holland, Mich.

[21] Appl. No.: 717,377

[22] Filed: Jun. 19, 1991

[30] Foreign Application Priority Data

Jun. 22, 1990 [DE] Fed. Rep. of Germany ..... 4019876

[51] Int. Cl.[5] ..... A47C 1/02

[52] U.S. Cl. ..... 297/316; 297/300; 297/320; 297/321

[58] Field of Search ..... 297/316, 317, 319, 320, 297/321, 322, 354, 355, 356, 300, 301

[56] References Cited

U.S. PATENT DOCUMENTS

| | | | |
|---|---|---|---|
| 4,640,548 | 2/1987 | Desanta | 297/301 X |
| 4,684,173 | 8/1987 | Locher | 297/301 X |
| 4,709,962 | 12/1987 | Steinmann | 297/301 |
| 4,761,033 | 8/1988 | Lanuzzi et al. | 297/316 |
| 4,773,706 | 9/1988 | Hinrichs | 297/316 X |

*Primary Examiner*—Laurie K. Cranmer
*Attorney, Agent, or Firm*—Flynn, Thiel, Boutell & Tanis

[57] ABSTRACT

A chair, in particular an office chair, including a seat and a back rest which are pivotal in relationship to a supporting column supporting these. The back rest is mounted on a carrier for pivotal movement about a fixed first horizontal axis. A downwardly directed first control means is mounted on the carrier for pivotal movement about a second axis which is located in front of the first axis. The lower area of the first control means is mounted for pivotal movement about a third axis at the lower end of a second control means. The second control means extends upwardly to the front area of the seat and there is connected for pivotal movement about a fourth axis. The carrier is connected at a fifth horizontal axis located below the second axis on the carrier to a substantially horizontal third control means, the other end of which third control means is pivotally coupled connected for pivotal movement about a sixth axis, lying above the third axis, with the second control means. The carrier, through which the back rest is pivotally mounted to the column, and the second control means, which supports the front area of the seat, are therefore coupled through the intersecting control means so that the back rest and the seat carry out reflected inverted image movements so to speak and remain balanced during any type or force by the user of the chair.

5 Claims, 1 Drawing Sheet

CHAIR

BACKGROUND OF THE INVENTION

1. Field of the Invention

This invention relates to a chair, in particular an office chair, comprising a seat and a back rest which are pivotable with respect to the column that supports them.

2. Description of the Prior Art

Many forms of chairs of the before-mentioned type are known. In addition to a purely elevational adjustment, they also permit pivoting of the seat and the back rest about horizontal, transversely directed axes so that the chair can be adjusted to different sitting positions of the user, for example, a straight, erect, working position or a leaning-back, resting position.

Conventional chair constructions of this type employ springs which resiliently resist pivoting of the seat and back rest, caused by the weight of the user or by a force applied by the user, and resiliently urge the chair into a selected, initial position. These springs represent a not-insignificant portion of the total manufacturing cost of the chair because they are made of high-quality materials, they must be carefully anchored and, taking into consideration the requisite spring deflection, they may require a considerable amount of space. A further structural disadvantage is that the extent of spring deflection varies with chair occupants of different weights. To provide a spring behavior which is substantially independent of the load requires at least a relatively complicated and expensive adjusting mechanism.

SUMMARY OF THE INVENTION

The basic purpose of the invention is to provide a chair of the before-mentioned type, which can be adjusted easily into any desired sitting position independently of the weight of the user and which assumes a balanced position over the entire range of movement of the seat and the back rest.

This purpose is attained, according to the invention, (1) by mounting the back rest on a carrier which is pivotable about a first, horizontal axis which is fixed with respect to the column, (2) by mounting a downwardly extending first control means on the carrier for pivotal movement about a second pivot axis which is located in front of the first axis, (3) by pivotally connecting, at a third pivot axes, the lower end of the first control means to the lower end of a second control means, which second control means extends upwardly toward the front section of the seat and is coupled there for pivotal movement with respect to said seat about a fourth pivot axis, and (4) by pivotally connecting the carrier, at a fifth pivot axis located below the second pivot axis, to a substantially horizontal third control means, the other end of which is pivotally connected at a sixth pivot axis, which is above the third pivot axis, to the second control means.

The above-described chair mechanism has the advantage that the chair will be stabilized in every possible position, independently of the weight of the user, without requiring the use of springs. This results in a relatively simple and inexpensive construction.

A key feature of the invention is the provision of the two, crossing, first and third, control means, which are pivotally supported one above the other on the carrier of the back rest in an end area provided in front of the first, fixed, horizontal pivot axis of the carrier. These crossing, first and third, control means in turn are mounted for pivotal movement about axes lying one above the other on the second control means, which second control means is connected to the front underside of the seat. The connections of the back rest and seat provide an operation in which during tilting back of the back rest, the seat is moved forwardly and is slightly lowered, as is necessary in the rest position, while when the back rest is moved to an erect position, the seat moves back and is lifted in front.

This basic principle brings about significant advantages. Moreover, a specific chair mechanism can be optimized by appropriate dimensioning of the individual control means to meet the requirements of a specific design.

All the axes or pivot axes mentioned herein are horizontal axes which extend transversely (crosswise) with respect to the seat direction. Only one of these axes, namely the first pivot axis, connecting the carrier of the back rest to the column, is fixed with respect to the column. The other axes can be moved frontwardly and backwardly, relative to the column within the limits of the linkage.

The rearward section of the seat is preferably supported on the carrier for longitudinally sliding movement frontwardly and rearwardly. The first fixed pivot axis of the carrier is supported on a rearwardly directed arm of the column. The fourth pivot axis between the front section of the seat and the upper end of the second control means can be formed by elastic blocks, for example, of rubber.

BRIEF DESCRIPTION OF DRAWINGS

A preferred exemplary embodiment of the invention will be discussed in greater detail hereinafter in connection with the enclosed drawings, in which.

DETAILED DESCRIPTION

Figure 1:
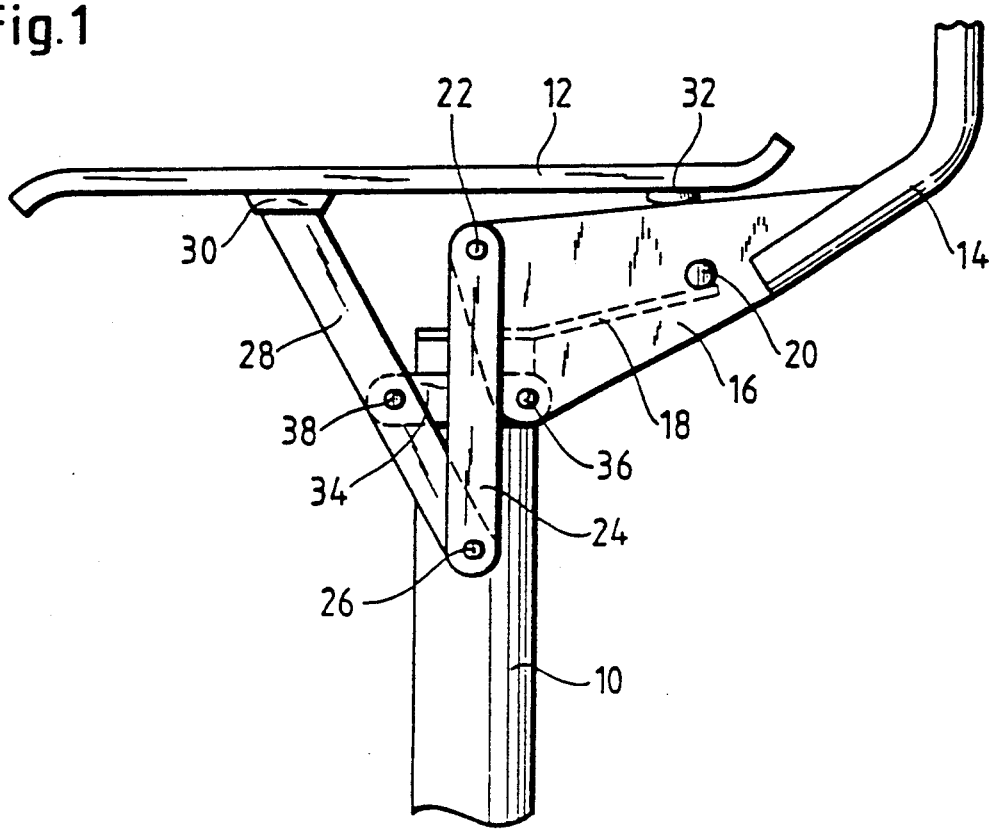
FIG. 1 is a partial schematic view of a chair of the invention.

Referring to FIG. 1, the chair comprises a vertical support column, post or pedestal 10, a horizontal seat 12 and an upwardly extending back rest 14. Only fragments of the column and the back rest are illustrated. The back rest 14 is fixedly mounted on a carrier 16, which is illustrated as being a substantially triangular plate. The carrier 16 is supported for pivotal movement about a horizontal axis 20 which axis extends transversely with respect to the chair and is fixedly mounted on a rearwardly extending arm 18 of the column 10. The axis 20 will be referred to hereinafter as the first axis. The back rest 14 together with the carrier 16 forms a lever, with the axis 20 serving as the swivel axis, so that when the front portion of the carrier 16 which lies in front or on the left of axis 20 in the drawing, is pivoted upwardly, then the back rest 14 moves backwardly and downwardly, and vice versa.

A second horizontal axis 22 is provided in the upper region of the front portion of the carrier 16, which portion lies in front of the first axis 20. The upper end of a substantially vertically, downwardly directed, first control means 24, such as a link, is supported for pivotal movement about the second axis 22. A further axis 26, hereinafter referred to as the third axis, is provided at the lower end of the first control means 24. A second control means 28, for example, a link, extends upwardly from the third axis 26 and is inclined forwardly. The upper end of the control means 28 provides a fourth axis 30 formed by soft, elastic blocks pivotally connecting the upper end of control means 28 to the underside of the front section of the seat 12.

The rearward section of the seat 12 is supported on the upper side of the carrier 16 by sliders 32.

When the back rest 14 is tilted backwardly, the first control means 24 is pulled downwardly and rearwardly. This movement is transferred to the second control means 28, the position of which, however, is not sufficiently limited by the control means 24 alone.

Therefore, a third control means 34, such as a link, is provided, which extends substantially horizontally and crosses the first control means 24 at substantially a right angle. The third control means 34 is mounted at one end on the carrier 16 for pivotal movement about a fifth pivot axis 36 located at a position in front of the fixed axis 20 and below the second axis 22. The other end of the third control means 34 is mounted on the second control means 28 for pivotal movement about a sixth pivot axis 38 located at a position above the third axis 26 and in a broader sense in the central section of the second control means 28.

Figure 2:
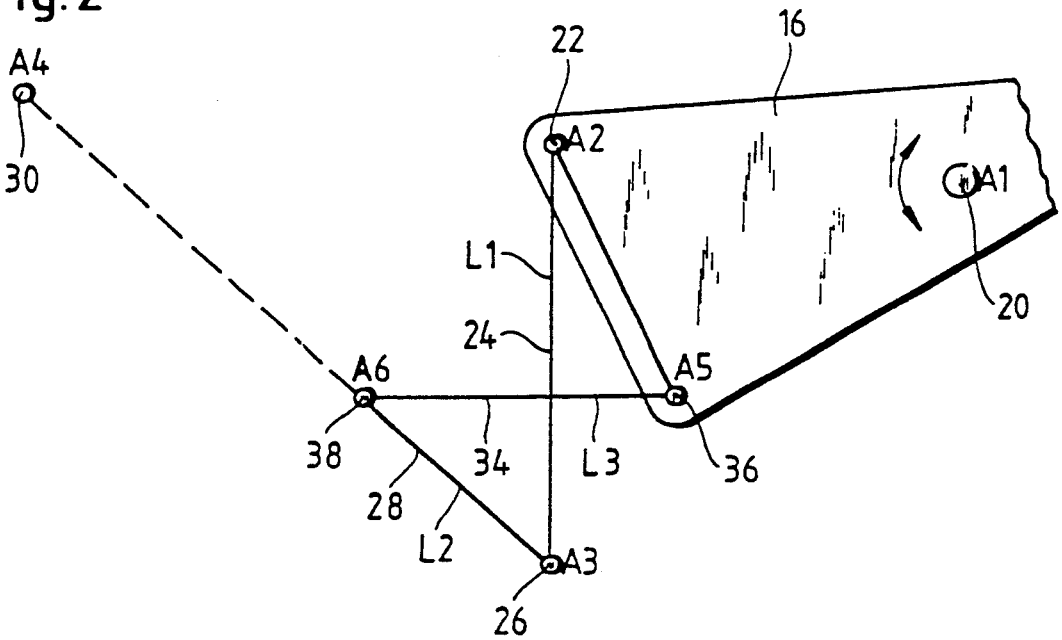
FIG. 2 is a schematic illustration illustrating only the axes and control means to further explain the invention.

FIG. 2 shows in a further simplified illustration, mainly of the axes and control means and their cooperation. The individual axes and control means are in this case identified not only by the previously used reference numerals, but also by the reference numerals A1, A2, A3 . . . for the axes and L1, L2, L3 . . . for the control means.

The carrier 16 indicated in FIG. 2 is pivotable about the axis 20 which is fixed with respect to the column 10. The second and fifth axes 22, 36 are provided on the carrier 16 in front of the axis 20. The length from 22 to 36 forms the base of a toggle linkage in which the ends of intersecting first and third control means 24, 34 are connected to the second control means 28 at the axes 38, 26. The length from 38 to 26 of the second control means 28 forms the counterpart to the length 22-36 of the linkage on the carrier 16. During pivoting of the carrier 16, the length 38-26 is moved so to speak in reflected inverted image relationship with respect to the length 22-36. That is, when length 22-36 is moved clockwise (FIG. 2), the length 26-38 is moved counterclockwise, and vice versa. The extension of the control means 28 to the fourth pivot axis 30 effects then a translation of the movement of the length 38-26.

It is obvious that the invention offers many possibilities for variations with respect to the dimensions and the arrangement of the control means and axes, which possibilities vary the extent of movement between the back rest and the seat without departing from the scope of the invention.

This description does not contain details regarding the dimensions of the individual members of the chair mechanism, because it is easily possible to find the desired optimum sequence of operation with the help of a model, in which the length of the individual control means and the position of the axes can be adjusted.

I claim:

1. In a chair, in particular an office chair, comprising a seat and a back rest which are pivotal in relationship to a supporting column, the improvement which comprises: the back rest is mounted on a carrier which is pivotable about a first horizontal axis which is fixed with reference to the column, a downwardly directed first control means is mounted for pivotal movement about a second axis which is provided on the carrier in front of the first axis, a second control means is directed upwardly toward a front section of the seat, a lower end of said first control means being mounted for pivotal movement about a third axis at a lower end of said second control means, an upper end of said second control means being connected for pivotal movement about a fourth axis with respect to the front section of said seat, said carrier is connected for pivotal movement about a fifth horizontal axis mounted below the second axis on the carrier with respect to a substantially horizontal third control means, the other end of said third control means being mounted for pivotal movement about a sixth axis lying above the third axis on the second control means.

2. A chair according to claim 1, in which a rearward area of the seat is supported by the carrier for front to rear reciprocating movement.

3. A chair according to claim 1, characterized in that the first, axis, of the carrier is fastened on a rearwardly directed arm of the column.

4. A chair according to claim 1, characterized in that the fourth axis between the front section of the seat and the second control means is formed by elastic blocks.

5. A chair comprising an upright column, a backrest carrier extending rearwardly from said column and mounted thereon for pivotal movement with respect thereto about a first horizontal pivot axis which extends transversely to said carrier, a backrest mounted on said carrier for pivotal movement therewith about said first pivot axis, a seat having a rear end and a front end, said seat being movable forwardly and rearwardly relative to said backrest; a downwardly extending first control link located below said seat and having an upper end pivotally connected to said carrier for pivotal movement with respect thereto about a second horizontal pivot axis which is located in front of said first pivot axis and is parallel thereto, an upwardly extending second control link having a lower end pivotally connected to the lower end of said first control link for pivotal movement about a third horizontal pivot axis which is located below said first pivot axis and is parallel thereto, said second control link being inclined forwardly and being connected to the underside of said seat toward the front thereof for pivotal movement about a fourth horizontal pivot axis which is located in front of said second and third pivot axes and is parallel thereto, a substantially horizontal third control link having a front end and, a rear end, the rear end cf said third link being pivotally connected to said carrier for pivotal movement about a fifth horizontal pivot axis which is parallel with said first and second pivot axes and is located therebelow and close to the front of said carrier, and the front end of said third link is pivotally connected to said second control link for pivotal movement about a sixth pivot axis which is parallel with and is located between said third and fourth pivot axes, said third control link extending substantially at a right angle to and crossing the second control link.

* * * * *

UNITED STATES PATENT AND TRADEMARK OFFICE

CERTIFICATE OF CORRECTION

PATENT NO. : 5 080 435

DATED : January 14, 1992

INVENTOR(S) : Simon Desanta

It is certified that error appears in the above-identified patent and that said Letters Patent is hereby corrected as shown below:

Column 4, line 24; delete the comma after "first".
line 53; delete the comma after "and".
line 54; change "cf" to ---of---.

Signed and Sealed this

Twelfth Day of October, 1993

*Attest:*

*Attesting Officer*

BRUCE LEHMAN

*Commissioner of Patents and Trademarks*